US011517896B2

(12) United States Patent
Aziz

(10) Patent No.: US 11,517,896 B2
(45) Date of Patent: Dec. 6, 2022

(54) TEST STRIP HOLDER

(71) Applicant: Luna Pharmaceuticals, Inc., Providence, RI (US)

(72) Inventor: Dan Aziz, Providence, RI (US)

(73) Assignee: Luna Pharmaceuticals, Inc., Providence, RI (US)

( * ) Notice: Subject to any disclaimer, the term of this patent is extended or adjusted under 35 U.S.C. 154(b) by 207 days.

(21) Appl. No.: 16/993,616

(22) Filed: Aug. 14, 2020

(65) Prior Publication Data

US 2022/0048024 A1 Feb. 17, 2022

(51) Int. Cl.
*B01L 3/00* (2006.01)
*B01L 9/00* (2006.01)

(52) U.S. Cl.
CPC ..... *B01L 3/5023* (2013.01); *B01L 9/52* (2013.01); *B01L 2300/0825* (2013.01); *B01L 2400/0406* (2013.01)

(58) Field of Classification Search
CPC .. B01L 3/5023; B01L 9/52; B01L 2300/0825; B01L 2400/0406
See application file for complete search history.

(56) References Cited

U.S. PATENT DOCUMENTS

| | | | |
|---|---|---|---|
| 5,424,035 | A | 6/1995 | Hoenes et al. |
| 6,872,358 | B2 | 3/2005 | Hagen et al. |
| 7,063,234 | B2 | 6/2006 | Giraud |
| 7,172,728 | B2 | 2/2007 | Otake |
| 7,803,322 | B2 | 9/2010 | Borich et al. |
| 8,715,571 | B2 | 5/2014 | Hanson et al. |
| 9,052,305 | B2 | 6/2015 | Newman et al. |
| 9,205,971 | B2 | 12/2015 | Zeleny et al. |
| 10,449,116 | B2 | 10/2019 | Adelson |
| 10,451,613 | B1 | 10/2019 | Wang et al. |
| 10,634,659 | B2 | 4/2020 | Bishop et al. |
| 10,656,150 | B2 | 5/2020 | Patwardhan |
| 2005/0256382 | A1 | 11/2005 | Eisenmann et al. |
| 2009/0108013 | A1 | 4/2009 | Van Der Velde et al. |
| 2010/0198142 | A1 * | 8/2010 | Sloan ..... G16H 20/10 345/173 |

(Continued)

FOREIGN PATENT DOCUMENTS

| | | |
|---|---|---|
| CA | 2424197 C | 12/2013 |
| CA | 2573255 C | 12/2014 |

(Continued)

*Primary Examiner* — Jennifer Wecker
*Assistant Examiner* — Alea N. Martin
(74) *Attorney, Agent, or Firm* — Mintz, Levin, Cohn, Ferris, Glovsky and Popeo, P.C.

(57) ABSTRACT

A test strip device including a housing, at least one retention arm, an ejection tab, and a viewing window. The housing includes a channel extending through the housing, with an opening at a first end of the housing, the channel being configured to receive a test strip therein. The at least one retention arm is arranged within the channel and configured to retain the test strip within the channel. The ejection tab is slideably arranged within the housing and configured to slide the test strip through the channel and out of the opening. The viewing window is arranged within the housing and configured to allow a results region of the test strip disposed within the channel to be viewed through the viewing window.

20 Claims, 5 Drawing Sheets

(56) References Cited

U.S. PATENT DOCUMENTS

| | | | | |
|---|---|---|---|---|
| 2011/0184264 | A1* | 7/2011 | Galasso | A61M 5/1723 600/347 |
| 2012/0029830 | A1 | 2/2012 | Turner et al. | |
| 2014/0014677 | A1 | 1/2014 | Chan et al. | |
| 2014/0271400 | A1 | 9/2014 | Cheng et al. | |
| 2016/0121322 | A1* | 5/2016 | Fuller | B01L 3/5023 422/417 |
| 2018/0071741 | A1 | 3/2018 | Kelly et al. | |
| 2019/0271653 | A1 | 9/2019 | Xie et al. | |
| 2019/0317115 | A1 | 10/2019 | MacLean et al. | |

FOREIGN PATENT DOCUMENTS

| | | | |
|---|---|---|---|
| CA | 2835329 | C | 7/2020 |
| EP | 2332655 | B1 | 3/2013 |
| WO | 2014122673 | A2 | 8/2014 |

* cited by examiner

TEST STRIP HOLDER

TECHNICAL FIELD

This disclosure generally relates to test strip holders for disposable test strips, and more specifically to test strip holders for use with a plurality of different sized disposable test strips.

BACKGROUND

Disposable test strips may be used for various sample collections, for example, a urine pregnancy test or ovulation test. When a sample is placed on a disposable test strip, capillary action carries the sample from a depositing region of the test strip to a results region of the test strip. Such disposable test strips are manufactured with predetermined designs and chemicals in order to indicate a result of the sample collection directly on the test strip used for the collection.

Current test strips are provided by different manufactures and thus have different dimensions and specifications. As a result, the test strips are either utilized as a stand-alone strip, which can be difficult to handle, or are provided with a corresponding housing, with both the test strip and the housing being disposable after a single sample collection.

SUMMARY

In general, test strip holders, test strip holder kits, and methods of using a test strip holder are provided.

In one embodiment, a test strip device is provided and includes a housing, at least one retention arm, an ejection tab, and a viewing window. The housing includes a channel extending through the housing with an opening at a first end of the housing. The channel can be configured to receive a test strip therein. The at least one retention arm can be arranged within the channel and can be configured to retain the test strip within the channel. The ejection tab can be slideably arranged within the housing and can be configured to slide the test strip through the channel and out of the opening. The viewing window can be arranged on the housing and can be configured to allow a results region of a test strip disposed within the channel to be viewed through the viewing window.

In one embodiment, the at least one retention arm can be configured to deform within the channel in a displacement direction orthogonal to a longitudinal axis of the channel. For example, the at least one retention arm can be in the form of a deflectable spring. In certain aspects, the at least one retention arm can be monolithic to the housing so that the housing and at least one retention arm are formed form a single piece of material. In other aspects, the at least one retention arm can include a first retention arm and a second retention arm arranged within the channel, where the first retention arm and the second retention arm are positioned on opposite sidewalls of the channel for engaging a test strip between the two retention arms. In embodiments including two retention arms, a distance between the first retention arm and the second retention arm can be adjustable such that the first retention arm and the second retention arm are configured to engage test strips having a range of widths. In certain embodiments, the first retention arm and the second retention arm can each be in the form of a deflectable member configured to each apply a force to opposed edges of a test strip disposed within the channel.

The ejection tab can also have a variety of configurations, and in one embodiment may be slideably disposed within an ejection slot formed in an upper surface of the housing. In an exemplary embodiment, the ejection tab can be configured to engage a terminal end of the test strip for sliding the test strip through the channel. The ejection slot may be positioned adjacent to a second end of the housing that is opposite to the first end of the housing.

The viewing window can also have various configurations, and in one embodiment may be positioned adjacent the first end of the housing. The viewing window can be in the form of a slot formed in an upper surface of the housing, and the ejection tab may be positioned on the upper surface of the housing within the slot.

In another embodiment, a test strip kit is provided and includes a first test strip, a second test strip, and a test strip holder. The first test strip has a first width, and the second test strip has a second width that is different from the first width. The test strip holder can include a housing and at least one retention arm. The housing can include a channel configured to receive one of the first test strip and the second test strip. The at least one retention arm can be arranged within the channel and can be configured to retain the first test strip when the first test strip is disposed within the channel, and can be configured to retain the second test strip when the second test strip is disposed within the channel.

In one embodiment, when the first test strip is arranged within the channel, the at least one retention arm is displaced a first distance, and when the second test strip is arranged within the channel, the at least one retention arm is displaced a second distance that is greater than the first distance. In some embodiments, the at least one retention arm can include first and second retention arms positioned on opposed sides of the channel. The first and second retention arms can be movable relative to one another such that a width extending between the retention arms is adjustable.

In other embodiments, the test strip holder can include an ejection tab slideably arranged along the housing and configured to slide the first test strip and second test strip out of the channel.

In other embodiments, the test strip holder can include a viewing window formed in the housing and positioned such that, when one of the first test strip and second test strip is arranged within the channel, a results region on the one of the first test strip and the second test strip may be positioned within the viewing window.

In another embodiment, a test strip holding device is provided and includes a housing, a first retention arm, a second retention arm, and an ejection tab. The housing includes a channel configured to receive a test strip in an insertion direction. The channel can have a first sidewall and a second side wall. The first retention arm is arranged on the first sidewall of the channel, and the second retention arm is arranged on the second sidewall of the channel. When a test strip is arranged within the channel, the first retention arm is displaced in a first displacement direction and the second retention arm is displaced in a second displacement direction, and the first displacement direction and the second displacement direction can be orthogonal to the insertion direction of the test strip. The ejection tab is slideably arranged along the housing and configured to slide the test strip out of the channel in an ejection direction, which is opposite the insertion direction.

In other embodiments, the test strip holding device can further include a viewing window arranged in the housing and positioned to allow a results region of a test strip disposed within the channel to be viewed through the viewing window.

In other embodiments, the first retention arm and the second retention arm can each be in the form of a deflectable spring configured to each apply a force to opposed edges of a test strip disposed within the channel.

BRIEF DESCRIPTION OF THE DRAWINGS

A brief description of each drawing is provided to more sufficiently understand drawings used in the detailed description of the present disclosure.

It should be understood that the above-referenced drawings are not necessarily to scale, presenting a somewhat simplified representation of various features illustrative of the basic principles of the disclosure. The specific design features of the present disclosure, including, for example, specific dimensions, orientations, locations, and shapes, will be determined in part by the particular intended application and use environment.

DETAILED DESCRIPTION

Disposable test strips for testing sample fluids are manufactured with predetermined designs and chemicals in order to indicate a result of a sample collection directly on the test strip used for the collection. Examples of this include pregnancy tests, ovulation tests, and blood tests. However, current test strips are provided by different manufactures and thus have different dimensions and specifications, and thus are either used as a stand-alone test strip or contain an integral housing which is disposed of with the test strip. Accordingly, a test strip holder is provided that is configured to hold test strips having varying sizes. The test strip holder can also be reusable, thus eliminating waste.

Figure 1A:
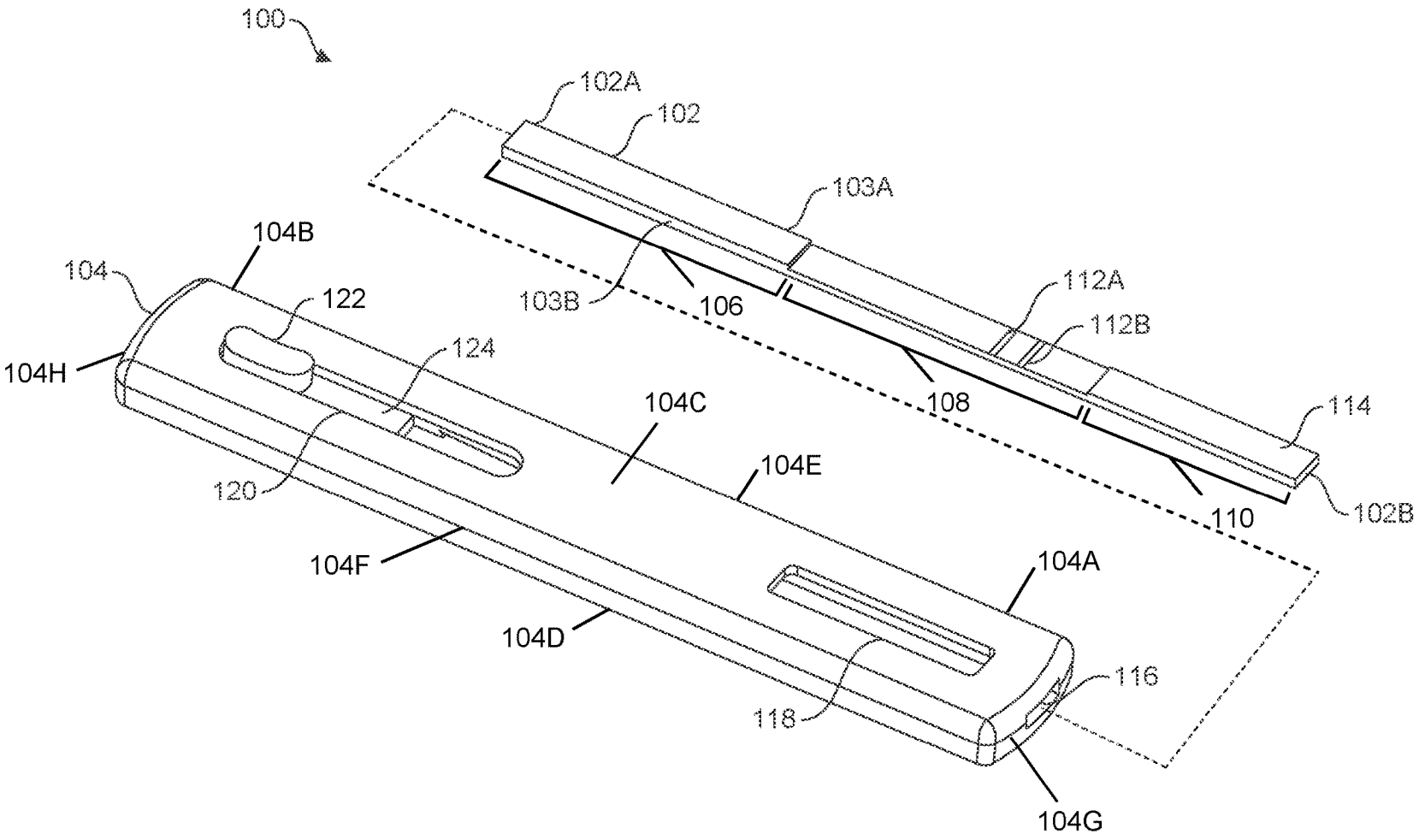
FIG. 1A is a partially exploded perspective view of a test strip holder and test strip according to one embodiment.
Figure 1B:
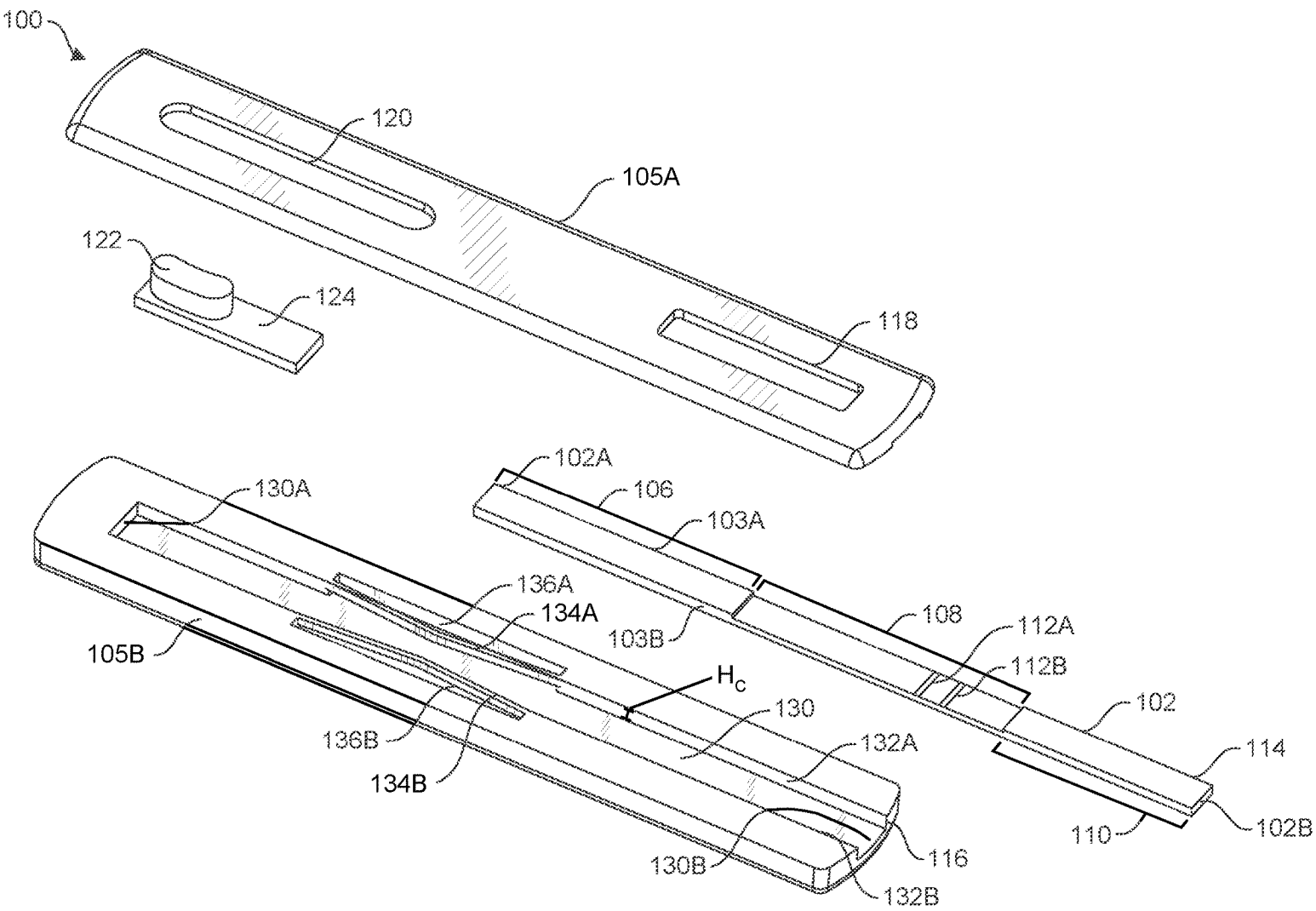
FIG. 1B is an exploded perspective view of the test strip holder and test strip of FIG. 1A.

FIGS. 1A and 1B show one exemplary embodiment of a test strip holder assembly 100 that includes a test strip 102 and a test strip holder 104. In general, the test strip holder 104 is configured to receive the test strip 102 therein for testing, and is configured to eject the test strip for disposal after testing is complete. This configuration allows the test strip holder 104 to be reusable by replacing a used test strip 102 with a new, unused test strip 102. Additionally, the test strip holder 104 can be used with various types of test strips 102, such as test strips having differing lengths, width, and/or thicknesses. By using a reusable test strip holder 104, cost can be reduced since only the test strip 102 needs to be replaced between uses. Also, since the test strip holder 104 can be used with various sizes of test strips, this would also increase efficiency and decrease cost since only a single type of test strip holder 104 can be used with many types of test strips.

Still referring to FIGS. 1A and 1B, the illustrated test strip 102 has a generally elongate rectangular configuration with a proximal end 102A, a distal end 102B, and opposed edges 103A, 103B extending from the proximal end 102A to the distal end 102B. The test strip 102 may include various distinct sections there along in order to be used with the test strip holder 104. For example, the illustrated test strip 102 includes a retention section 106, a results section 108, and a testing section 110 arranged along the length of the test strip 102 from the proximal end 102A to the distal end 102B. The results section 108 may include an indicator, such as indicators 112A and 112B. The indicators 112A, 112B project the results from the testing section 110. The indicators 112A, 112B may be any form of indicator due to a chemical reaction, such as a color changing material. The indicators 112A, 112B are influenced by a test sample gathered in the testing section 110. The testing section 110 may include a testing portion 114 arranged on the distal end 102B of the test strip 102. The testing portion 114 may be used to collect a sample, which is transferred along the test strip 102 from the testing section 110 to the results section 108. The collected sample may be transferred along the test strip 102 through capillary action within the material of the test strip 102, but other forms of material transfer may be used and should be considered. A person skilled in the art will appreciate that the test strip can have various configurations, and is not limited to the illustrated test strip. As indicated above, the test strip holder is configured to be used with different types of test strips, and thus any test strip known in the art can be used. In certain exemplary embodiments, as will be discussed in more detail below, the test strip holder can be used with test strips having different widths as measured between the opposed edges 103A, 103B.

Still referring to FIGS. 1A and 1B, the test strip holder 104 is used to house the test strip 102 during a sample collection in order to keep a user's hands from directly contacting the sample or the test strip 102. The test strip holder 104 is in the form of a housing having a generally elongate rectangular configuration with first and second ends 104A, 104B, upper and lower sidewalls 104C, 104D, left and right sidewalls 104E, 104F, and first and second end walls 104G, 104H. In the illustrated embodiment, the first and second end walls 104G, 104H are curved, however a person skilled in the art will appreciate that the housing can have any configuration to facilitate handling of the device. In some implementations, the test strip holder 104 is composed of a top portion 105A and a bottom portion 105B. The top portion 105A and the bottom portion 105B can be removably or permanently secured together in order to form the channel 130 within the test strip holder 104. As depicted, the channel 130 extends along the length of the test strip holder 104.

As further shown in FIGS. 1A and 1B, the housing 104 includes a channel 130 extending at least partially therethrough. In the illustrated embodiment, the channel 130 has a rectangular configuration and originates at an opening 116 formed in the first end 104A of the test strip holder 104, and terminates just prior to the second end 104B of the test strip holder 104 such that the second end 104B is closed. The channel 130 includes a proximal end 130A and a distal end 130B, with the distal end 130B arranged adjacent to the opening 116. The channel 130 also includes sidewalls 132A and 132B which end along the channel's length. A person skilled in the art will appreciate that the channel can extend along any length of the test strip holder 104 and can also extend completely therethrough such that the holder has openings at both ends. In the illustrated embodiment, the test strip 102 is configured to be inserted into the opening 116. Accordingly, a width We and height $H_C$ of the channel can be maximized to accommodate a range of test strips of varying sizes. Current test strips can have widths within a range of 3-6 millimeters, and thus the channel can have a width greater than 6 millimeters. The height $H_C$ of the channel can also vary as needed depending on the height of the test strip.

The test strip holder can also include a viewing window 118 arranged in the top portion 104A of the test strip holder 104. In an exemplary embodiment, the location of the viewing window 118 corresponds to the location of the results section 108 of the test strip 102, and specifically to the indicators 112A, 112B so that a user can see the results of the sample collection prior to removing the test strip 102 from the test strip holder 104. The viewing window 118 can have various configurations, but in the illustrated embodiment it is in the form of a cutout arranged in the top portion 105A of the test strip holder 104 so that the results section of the test strip 102 can be clearly seen. In some embodiments, the viewing window 118 may include a transparent covering so that the results section of the test strip 102 can still be seen, but cannot be contaminated through the viewing window 118. In the illustrated embodiment, the viewing window 118 is positioned adjacent to the first end 104A of the test strip holder 104, but is spaced apart from the first end wall 104G. In this configuration, the viewing window 118 is separated from the opening 116 by a portion of the upper side wall 104C. A width and length of the viewing window 118 can be maximized to accommodate a range of test strips of varying sizes. In certain embodiments, the viewing window 118 can have a width in the range of 3-6 millimeters, and a length in the range of 2.5-7 millimeters.

The test strip holder 104 can also include an ejector tab 122 arranged on the test strip holder 104. The ejection tab 122 can be arranged to allow a user to eject a used test strip 102 from the test strip holder 104. In the illustrated embodiment, the ejection tab 122 is secured to a slider 124 disposed within the channel 130 such that the ejection tab 122 projects through a sliding channel 120 formed in the top portion 105A of the test strip holder 104. A person skilled in the art will appreciate that the ejection tab and slider can have a variety of other configurations and can be positioned at various locations on the holder 104. The slider 124 can have a width slightly smaller than the width We of the channel 130, and it can be positioned proximal to a test strip. Due to this arrangement, the slider 124 contacts the test strip 102 when the test strip 102 is inserted within the test strip holder 104 with the ejection tab 122 extending vertically upward through the sliding channel 120, giving a user the ability to eject the test strip 102 out of the opening 116 in the test strip holder 104. In the illustrated embodiment, the sliding channel 120 is formed adjacent to the second end 104B of the test strip holder 104, but is spaced a distance from the second end wall 104H.

As indicated above, the test strip holder can be configured to accommodate test strips of varying sizes, such as varying widths. Accordingly, the test strip holder can include one or more retention arm configured to engage a test strip. In the illustrated embodiment, the test strip holder includes first and second retention arms 134A, 134B arranged within the channel 130. Each retention arm 134A, 134B can have various configurations, but as shown each arm is in the form of a spring member. While separate springs can be disposed within the test strip holder, in the illustrated embodiment the retention arms 134A, 134B are monolithic with the test strip holder 104 so that the test strip holder and retention arms 134A, 134B are made from a single piece of material. This is achieved by forming a gap 136A, 136B behind each arm 134A, 134B. The gaps 136A, 136B allow for the retention arms 134A, 134B to deform along a displacement direction, which may be orthogonal to the insertion direction ID (shown in FIG. 2A) when the test strip 102 is inserted within the channel 130. Due to the arrangement of the retention arms 134A, 134B, a retention width $W_W$ is formed between the retention arms 134A, 134B when the retention arms 134A, 134B are fully extended into the channel 130. Accordingly, the retention width $W_W$ between the retention arms 134A, 134B can be minimized to accommodate a small test strip, and the width can increase when a force is applied thereto to accommodate larger test strips. In certainly exemplary embodiments, the retention arms 134A, 134B can have a retention width $W_W$ therebetween that is in the range of 2-6 millimeters. A person skilled in the art will appreciate that a variety of spring-like members or other deformable members can be utilized to engage test strips of varying sizes for retaining a test strip within the channel. Moreover, as indicated above, only a single retention feature can be utilized. Regardless of the configuration, the retention arm(s) are preferably designed to allow insertion and ejection of the test strip 102 with minimal effort, but to apply enough force to the test strip 102 to retain the test strip within the channel 130 during a sample collection.

The test strip holder 104 can be formed from various materials, such as a plastic or metal. In some implementations, the housing material can include an antiviral and/or antibacterial material for use in sterile settings. However, the housing material is not limited thereto, and various other durable materials can be used.

Figure 2A:
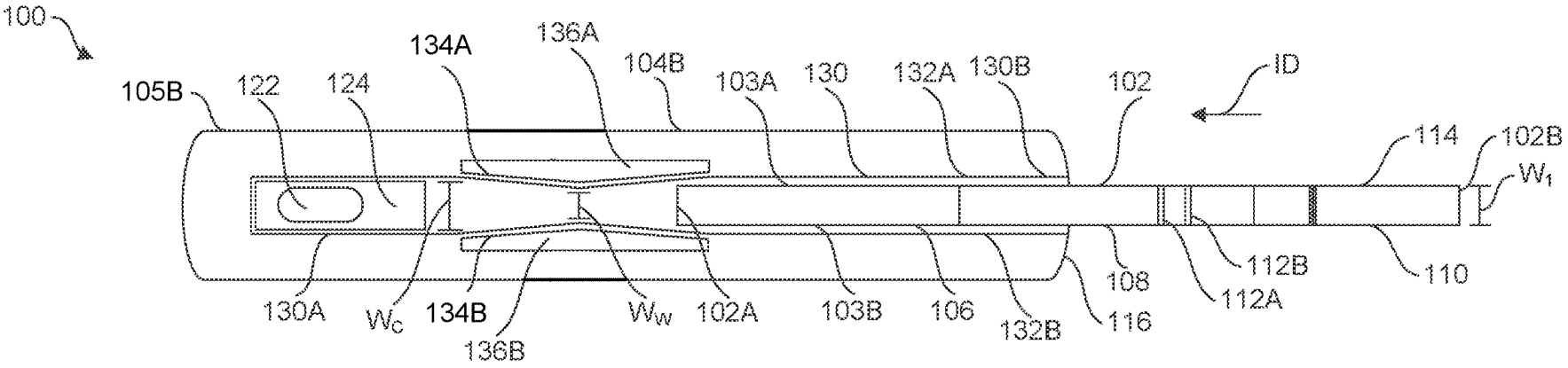
FIG. 2A is a top view of the test strip holder and test strip of FIG. 1A showing the test strip partially inserted into the test strip holder.
Figure 2B:
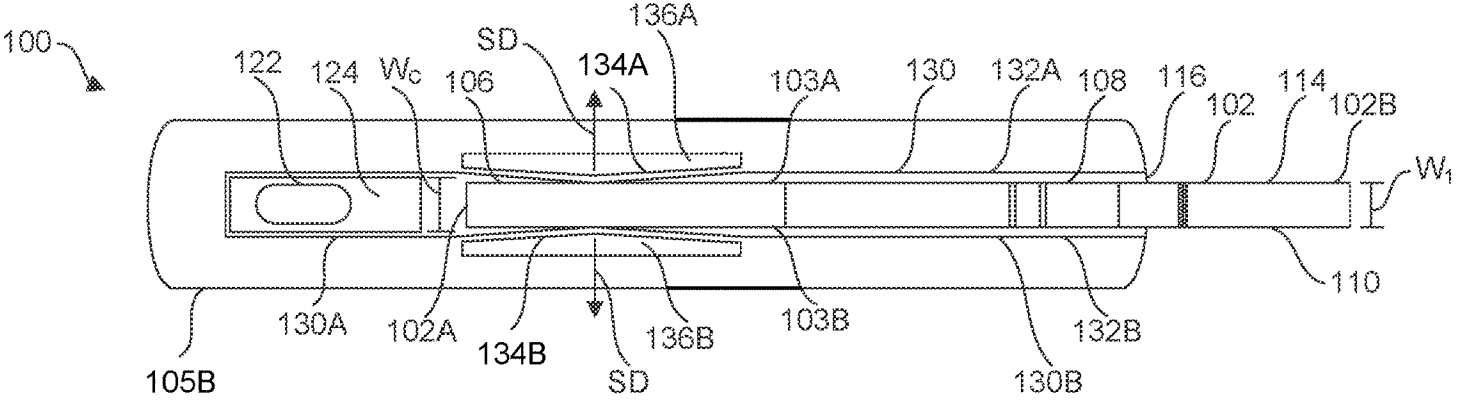
FIG. 2B is a top view of the test strip holder and test strip of FIG. 1A showing the test strip fully inserted into the test strip holder.

Referring now to FIGS. 2A and 2B, the insertion and retention of the test strip 102 with the test strip holder 104 is depicted. The top portion 105A of the test strip holder 104 is removed for clarity in both FIGS. 2A and 2B, but would be secured to the bottom portion 105B while the test strip holder 104 is being used. As stated previously, the test strip holder 104 may be used with test strips having various dimensions, such as width and length. As depicted in FIG. 2A, the test strip 102 has a width $W_1$. Also, the channel 130 has a width $W_C$ between the sidewalls 132A, 132B. In order for the test strip 102 to be inserted into the channel 130, the channel width $W_C$ is larger than the test strip with $W_1$. However, in order to retain the test strip 102 within the channel 130, the retention width $W_W$ is smaller than the test strip width $W_1$. Since the retention width $W_W$ is smaller than the test strip width $W_1$, as the test strip 102 is inserted into the channel 130 of the test strip holder 104 in the insertion direction ID, the retention arms 134A, 134B make contact with the edges 103A, 103B of the test strip 102, respectively. In some implementations, the test strip 102 is inserted into the channel 130 in the insertion direction until the proximal end 102A contacts the slider 124.

As depicted in FIG. 2B, the retention arms 134A, 134B are displaced in a displacement direction SD. In some implementations, the displacement direction SD is orthogonal to the insertion direction ID. As the retention arms 134A, 134B are pushed in the displacement direction SD, the the retention arms 134A, 134B deform into the gaps 136A, 136B, respectively. Due to the deformation of the retention arms 134A, 134B, the each retention arm 134A, 134B applies an opposite retention force to the edges 103A, 103B of the test strip 102 within the retention section 106 when the test strip 102 is inserted into the channel 130. In some implementations, the retention section 106 of the test strip 102 is more rigid when compared to the results section 108 and testing section 110 in order to withstand the force applied to the test strip 102 by the retention arms 134A, 134B and prevent deformation of the test strip 102. This retention force is able to secure the test strip 102 within the test strip holder 104 for a sample collection. Additionally, with both retention arms 134A, 134B applying equal and opposite retention forces to the edges 103A, 103B of the test strip 102, the test strip 102 is retained substantially within the center of the channel 130.

Figure 3A:
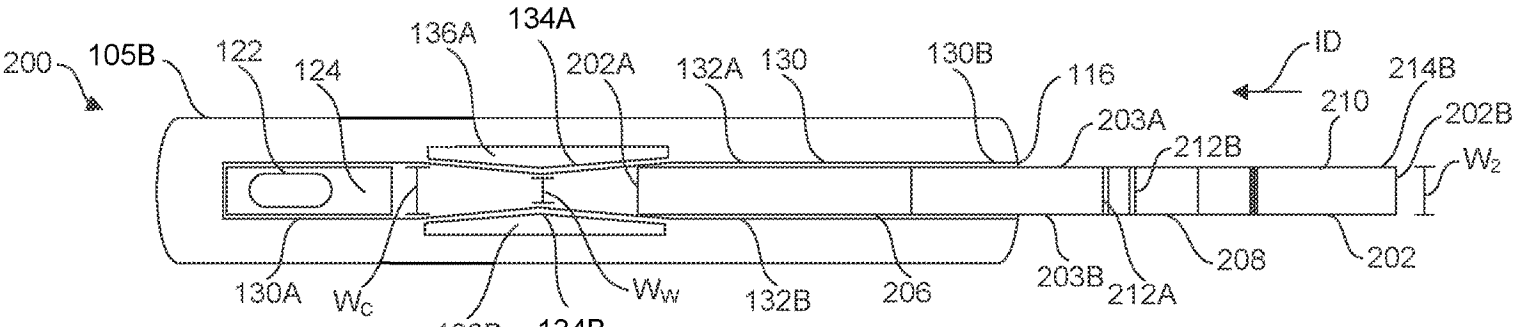
FIG. 3A is a top view of a test strip holder according to another embodiment, showing a test strip partially inserted into the test strip holder.
Figure 3B:
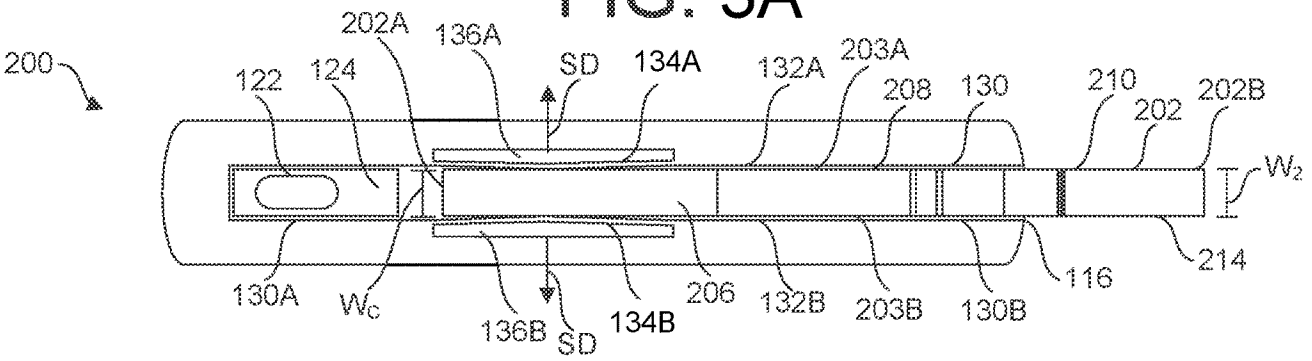
FIG. 3B is a top view of the test strip holder and test strip of FIG. 3A showing the test strip fully inserted into the test strip holder.

FIGS. 3A and 3B illustrate the test strip holder in use. In this embodiment, the assembly 200 includes test strip holder 104 and a test strip 202 that differs from the test strip 102 since the test strip 202 has a width $W_2$. The width $W_1$ of test strip 102 can be less than or greater than the width $W_2$ of test strip 202. It should be appreciated that any width of test strip can be used so long as the width of the test strip does not exceed the channel width $W_C$, and is also larger than the retention width $W_W$ so that the retention arms 134A, 134B can apply a retention force to the test strip.

As depicted in FIGS. 3A and 3B, the test strip 202 is inserted into the test strip holder 104 in an insertion direction ID. As the edges 203A, 203B of the test strip 202 contact the retention arms 134A, 134B, the retention arms 134A, 134B are deformed in the displacement direction SD, orthogonal to the insertion direction ID. In some implementations, the test strip 202 may be inserted into the channel 130 until the proximal end 202A contacts the slider 124 and retracts the ejection tab 122 within the sliding channel 120. Since the width $W_2$ of the test strip 202 is larger than the width $W_1$ of the test strip 102, the retention arms 134A, 134B are deformed a larger distance in the displacement direction SD by the test strip 202 when compared to the distance the test strip 102 displaces the retention arms 134A, 134B in the displacement direction SD.

Figure 3C:
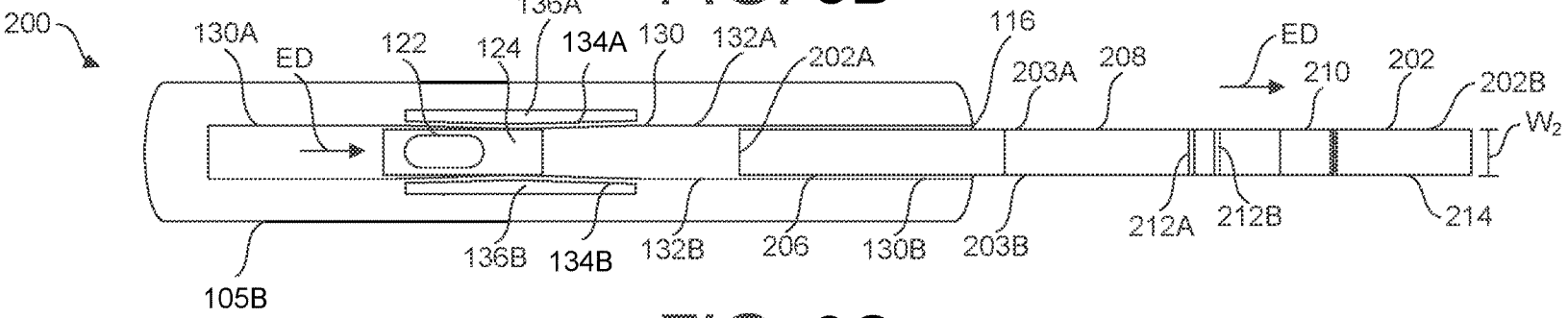
FIG. 3C is a top view of the test strip holder and test strip of FIG. 3A showing the test strip partially ejected from the test strip holder.

Referring now to FIG. 3C, the ejection of the test strip 202 from the test strip holder 104 is depicted. Once a sample collection is completed, the test strip 202 may be ejected from the test strip holder 104 so that a new, unused test strip may be used with the test strip holder 104 for a new sample collection. In order to eject the test strip 202 from the test strip holder 104, the ejection tab 122 is extended within the sliding channel 120 along the ejection direction ED, which is opposite the insertion direction ID. The test strip 202 is inserted and ejected from the same opening 116 of the test strip holder. Once the ejection tab 122 is fully extended within the sliding channel 120, the slider 124 will displace the test strip 202 in the ejection direction ED a large enough distance in order to disengage the edges 203A, 203B of the test strip 202 with the retention arms 134A, 134B of the retention arms 134A 134B. Once the test strip 202 is no longer engaged with the retention arms 134A, 134B, the test strip 202 can be freely withdrawn from the channel 130, or can be ejected using the force of gravity by holding the test strip holder 104 vertically.

Figure 4A:
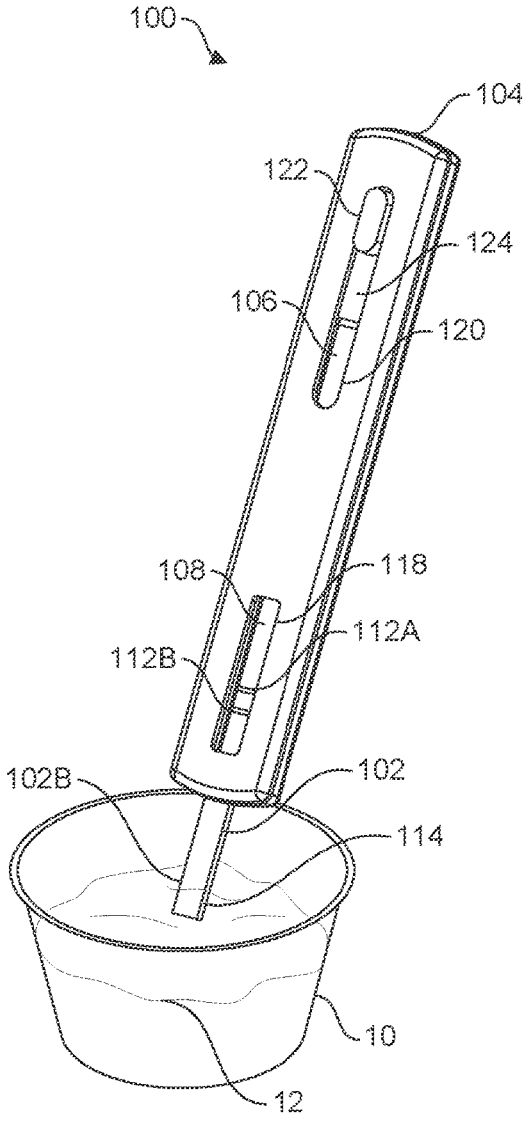
FIG. 4A is a perspective view of the test strip holder and test strip of FIG. 1A being used to test a sample.

FIG. 4A illustrates a method for collecting a sample using the test strip 102 and the test strip holder 104. In order to perform a sample collection, the test strip 102 is inserted into the test strip holder 104 through the opening 116. Once inserted into the test strip holder 104, the proximal end 102A of the test strip 102 abuts the slider 124 of the ejection tab 122. Additionally, the test strip 102 is retained within the test strip holder 104 via a retention arms 134A, 134B (shown in FIG. 2A). With the test strip 102 fully inserted within the test strip holder 104, the results section 108 of the test strip 102, and specifically the indicators 112A, 112B, are aligned within the viewing window 118 of the test strip holder 104. Additionally, the testing portion 114 of the testing section 110 extends outward from the test strip holder 104 when the test strip 102 is inserted within the test strip holder 104. Even though it is depicted in FIG. 4A that the ejection tab 122 is fully retracted within the sliding channel 120 in order to accommodate the test strip 102, various lengths of test strips can be used where the testing portion 114 extends outward from the test strip holder 104 and the proximal end 102A of the test strip contacts the slider 124, but the ejection tab 122 is not fully retracted within the sliding channel 120.

This configuration allows for a sample collection by contacting the testing portion 114 with a sample 12 arranged in a vessel 10. As described above, the sample 12 collected will be transferred through the test strip 102 to the results section 108, where the indicators 112A, 112B will react to show a result. However, other methods of contacting the testing portion 114 with the sample 12 can be used, and should be considered. For example, if the test strip 102 was a urine pregnancy test or ovulation test, the sample 12 could be directly deposited on the testing portion 114.

Figure 4B:
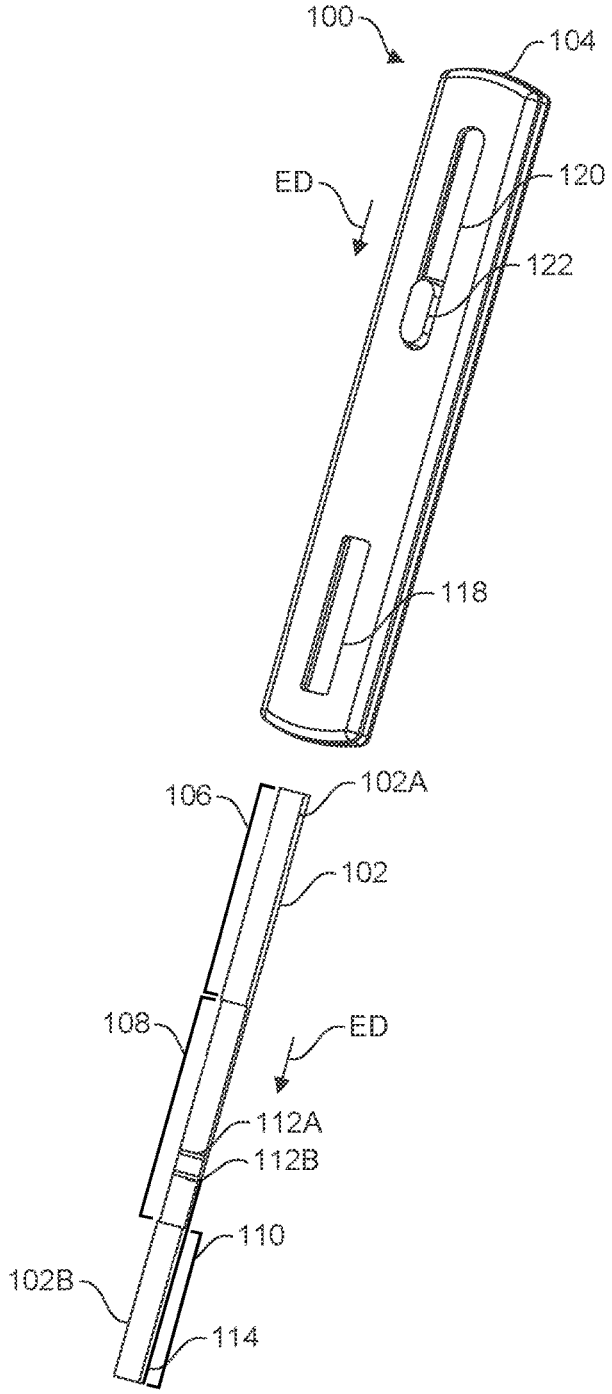
FIG. 4B is a perspective view of the test strip holder and test strip of FIG. 1A showing the test strip ejected from the test strip holder.

Referring now to FIG. 4B, once a test strip 102 has been used for a sample collection, the test strip 102 may be ejected from the test strip holder 104 so that the test strip holder 104 can be used with a new, unused test strip 102 for a different sample collection. In order to eject the test strip 102 from the test strip holder 104, the ejection tab 122 can be slid within the sliding channel 120 in an ejection direction ED, which is opposite the insertion direction ID (shown in FIG. 2A). As the ejection tab 122 is moved along the sliding channel 120 in the ejection direction ED, the slider 124 is also moved within the channel 130 (shown in FIG. 3C) in the ejection direction ED. As the slider 124 moves in the ejection direction ED, the slider 124 contacts and abuts the proximal end 102A of the test strip 102, forcing the test strip to be displaced out the test strip holder 104 in the ejection direction ED. In some implementations, the sliding channel 120, ejection tab 122, and slider 124 may be sized so that when the ejection tab 122 is fully extended within the sliding channel 120, as seen in FIG. 4B, the test strip 102 will no longer be in contact with the retention arms 134A, 134B. This allows the test strip 102 to freely slide out of the test strip holder 104 when the test strip 102 is no longer in contact with the retention means.

As set forth herein, a test strip holder device according to exemplary embodiments of the present disclosure includes a retention means for use with a plurality of differently sized test strips. Accordingly, the test strip holders according to the present disclosure can provide secure retention of disposable test strips, with the test strip holder being reusable for multiple sample collections. The test strip holder according to the present disclosure can be used for various sample collection applications, in healthcare applications, or the like.

The present disclosure is not limited to the exemplary embodiments described herein and can be embodied in variations and modifications. The exemplary embodiments are provided merely to allow one of ordinary skill in the art to understand the scope of the present disclosure, which will be defined by the scope of the claims. Accordingly, in some embodiments, well-known operations of a process, well-known structures, and well-known technologies are not be described in detail to avoid obscure understanding of the present disclosure. Throughout the specification, same reference numerals refer to same elements.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinabove, although the present disclosure is described by specific matters such as concrete components, and the like, the exemplary embodiments, and drawings, they are provided merely for assisting in the entire understanding of the present disclosure. Therefore, the present disclosure is not limited to the exemplary embodiments. Various modifications and changes can be made by those skilled in the art to which the disclosure pertains from this description. Therefore, the spirit of the present disclosure should not be limited to the above-described exemplary embodiments, and the following claims as well as all technical spirits modified equally or equivalently to the claims should be interpreted to fall within the scope and spirit of the disclosure.

What is claimed is:

1. A test strip device, comprising:

a housing including a channel extending therethrough with an opening at a first end of the housing, the channel being configured to receive a test strip therein;

at least one retention arm arranged within the channel and configured to retain the test strip within the channel;

an ejection tab slideably arranged on the housing and configured to slide the test strip through the channel and out of the opening; and a viewing window arranged within the housing and configured to allow a results region of the test strip disposed within the channel to be viewed through the viewing window, wherein the at least one retention arm is positioned in between the viewing window and the ejection tab.

2. The assembly of claim 1, wherein the at least one retention arm is configured to deform within the channel in a displacement direction orthogonal to a longitudinal axis of the channel.

3. The device of claim 1, wherein the at least one retention arm is monolithic with the housing.

4. The device of claim 1, wherein the at least one retention arm comprises a deflectable spring.

5. The device of claim 1, wherein the at least one retention arm comprises a first retention arm and a second retention arm arranged within the channel, wherein the first retention arm and the second retention arm are positioned on opposite sidewalls of the channel for engaging a test strip therebetween.

6. The device of claim 5, wherein a distance between the first retention arm and the second retention arm is adjustable such that the first retention arm and the second retention arm are configured to engage test strips having a range of widths.

7. The device of claim 5, wherein the first retention arm and the second retention arm each comprise a deflectable member configured to each apply a force to opposed edges of a test strip disposed within the channel.

8. The device of claim 1, wherein the ejection tab is slideably disposed within a slot formed in an upper surface of the housing, and is configured to engage a terminal end of the test strip for sliding the test strip through the channel.

9. The device of claim 8, wherein the ejection slot is positioned adjacent to a second end of the housing that is opposite to the first end of the housing.

10. The device of claim 1, wherein the viewing window is positioned adjacent the first end of the housing.

11. The device of claim 10, wherein the viewing window comprises a slot formed in an upper surface of the housing, and wherein the ejection tab is positioned on the upper surface of the housing.

12. A test strip kit, comprising:

a first test strip having a first width;

a second test strip having a second width, wherein the first width is different from the second width; and a test strip holder, comprising:

a housing including a channel configured to receive one of the first test strip and the second test strip;

an ejection tab slideably arranged within the channel;

a viewing window arranged within the housing; and at least one retention arm arranged within the channel and positioned between the viewing window and the ejection tab, wherein the at least one retention arm is configured to retain the first test strip when the first test strip is disposed within the channel, and configured to retain the second test strip when the second test strip is disposed within the channel.

13. The assembly of claim 12, wherein when the first test strip is arranged within the channel, the at least one retention arm is displaced a first distance, and when the second test strip is arranged within the channel, the at least one retention arm is displaced a second distance, wherein the first distance is smaller than the second distance.

14. The assembly of claim 12, wherein the ejection tab is slideably arranged along the housing and configured to slide the first test strip and second test strip out of the channel.

15. The assembly of claim 12, wherein the viewing window is formed in the housing and positioned such that, when one of the first test strip and second test strip is arranged within the channel, a results region on the one of the first test strip and the second test strip is positioned within the viewing window.

16. The assembly of claim 12, wherein the at least one retention arm comprises first and second retention arms positioned on opposed sides of the channel.

17. The assembly of claim 16, wherein the first and second retention arms are movable relative to one another such that a width extending therebetween is adjustable.

18. A test strip holding device, comprising:

a housing including a channel configured to receive a test strip in an insertion direction, the channel having a first sidewall and a second side wall;

a first retention arm arranged on the first sidewall of the channel;

a second retention arm arranged on the second sidewall of the channel;

wherein, when a test strip is arranged within the channel, the first retention arm is displaced in a first displacement direction and the second retention arm is displaced in a second displacement direction, the first displacement direction and the second displacement direction being orthogonal to the insertion direction of the test strip; and an ejection tab slideably arranged along the housing and configured to slide the test strip out of the channel in an ejection direction, wherein the ejection direction is opposite the insertion direction;

wherein at least one of the first retention arm and the second retention arm is positioned in between a viewing window and ejection tab.

19. The device of claim 18, wherein the viewing window arranged within the housing and positioned to allow a results region of a test strip disposed within the channel to be viewed through the viewing window.

20. The device of claim 18, wherein the first retention arm and the second retention arm each comprise a deflectable spring configured to each apply a force to opposed edges of a test strip disposed within the channel.

* * * * *